United States Patent [19]

Mellema

[11] Patent Number: 4,551,793

[45] Date of Patent: Nov. 5, 1985

[54] ROAD ILLUMINATION LUMINAIRE FOR POLE-MOUNTING

[75] Inventor: Sybe J. Mellema, Eindhoven, Netherlands

[73] Assignee: U.S. Philips Corporation, New York, N.Y.

[21] Appl. No.: 616,777

[22] Filed: May 31, 1984

Related U.S. Application Data

[63] Continuation of Ser. No. 416,839, Sep. 13, 1982, abandoned.

[30] Foreign Application Priority Data

Oct. 29, 1981 [NL] Netherlands ..... 8104892

[51] Int. Cl.[4] ..... F21S 1/10

[52] U.S. Cl. ..... 362/370; 362/388; 362/431; 248/558

[58] Field of Search ..... 362/368, 431, 371, 388, 362/370, 277, 285, 375, 414, 457, 458; 248/558, 207, 219.2

[56] References Cited

U.S. PATENT DOCUMENTS 2,816,214 12/1957 Bacon ..... 362/431

FOREIGN PATENT DOCUMENTS 1336351 11/1973 United Kingdom .

*Primary Examiner*—Stephen C. Bentley
*Assistant Examiner*—John S. Maples
*Attorney, Agent, or Firm*—Robert S. Smith

[57] ABSTRACT

A road illumination luminaire according to the invention has an assembly member and a housing having first and second apertures disposed respectively in a first upright side wall and in a lower wall of the housing to mount the luminaire on, for example, a horizontal or vertical end of a pole. The assembly member includes a cover member from which a sleeve extends. The assembly member is mounted on the housing by a cover member. The construction makes it possible to make a standard housing which can connect in at least two ways to a light pole and is suitable for poles having different diameters and also for poles having variously sloping ends.

1 Claim, 4 Drawing Figures

ROAD ILLUMINATION LUMINAIRE FOR POLE-MOUNTING

Figure 1:
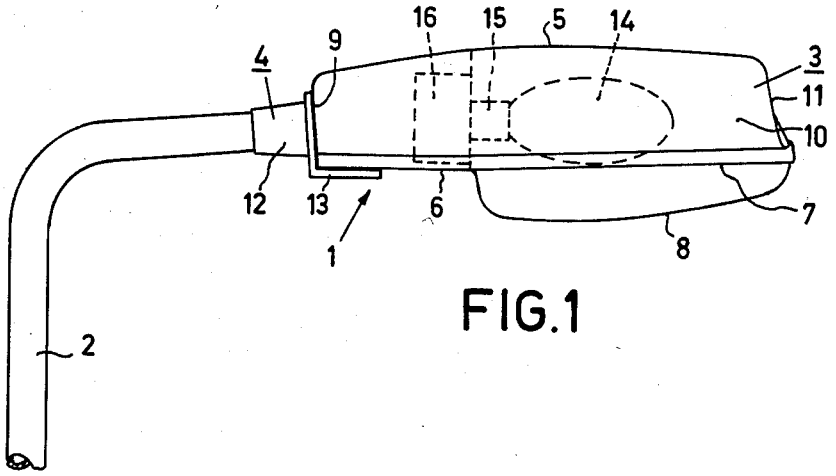

This is a continuation, of application Ser. No. 416,839, filed Sept. 13, 1982, now abandoned.

The invention relates to a road illumination luminaire for pole-mounting. The luminaire has a housing having a lower wall in which a light-emanating window is present, an upper wall, and side walls, which housing has respective apertures in the lower wall and in one side wall to enable the luminaire to be mounted on the end of a pole with either aperture facing the pole end. Means are provided to fix the luminaire to the pole. Such a road illumination luminaire is disclosed in British Patent Specification No. 1,336,351.

Poles for supporting luminaires for the illumination of roads, yards, railway yards, and the like are used in a variety of constructions. The poles differ not only in that they have either a vertical end of an inclined end, for example an approximately horizontal end, but also in that the diameters of the pole ends vary. Frequently-used diameters are 42–48 mm, 60 mm and 76 mm. In poles having an approximately horizontal end, said end often is at an angle of a few degrees, for example 5° to 15°, to the horizontal. This variety of pole constructions results in that the luminaires have to be manufactured and warehoused in a corresponding variety of constructions.

The luminaires disclosed in the British Patent Specification partly mitigates this disadvantage in that it is suitable for mounting both on horizontal and on vertical pole ends. However, the disadvantage of this luminaire is that it is constructed for mounting on a pole end of a given diameter and that it cannot, or cannot easily, be converted for mounting on a pole end of a different diameter.

It is the object of the invention to provide a road illumination luminaire which can easily be made suitable for mounting on a pole end of any particular diameter and inclination.

According to the invention, in a road illumination luminaire of the type mentioned in the opening paragraph this object is achieved in that said means comprises a cover member and, extending therefrom, a sleeve for receiving therein the end of a pole, the cover member being secured against the outside of the housing of the luminaire over the apertures in the lower wall and the said one side wall, the cover member being securable to the housing such that the sleeve cooperates with either one or the other of said apertures.

The road illumination luminaire according to the invention makes it possible for an electrician to preassemble or prepare the luminaire for assembly on a pole by providing the housing of the luminaire an assembly member, comprising said cover member and sleeve, which fits on the pole in question. When the luminaire is being mounted on the pole, the current cable in introduced into the aperture, and the sleeve of the assembly member is slid over the end of the pole and fixed to that end.

In a favorable embodiment the outer surface of the lower wall and the outer surface of the said one side wall at the area where the cover member is secured against the housing are at an external angle of 255° to 270° to each other and the sleeve extends substantially perpendicularly to one of the surfaces. This embodiment has for its advantage that an assembly member for a given pole diameter may be used both for mounting the luminaire to a vertical pole end and to an approximately horizontal pole end. In such a case only one assembly member need be available per pole diameter.

However, it is possible to give the sleeve of the assembly member a stepped inside diameter so that one assembly member fits two or more different pole ends.

In a favorable embodiment the transition of the lower wall to said one side wall of the housing in the region of the cover member is formed at least locally by an inclined face, the cover member of the assembly member having a correspondingly inclined face through which the assembly member is secured to the housing by means of a bolt.

The luminaire according to the invention has the advantage that the apertures in the housing can be closed entirely by means of the assembly member so that contamination of the interior of the housing is avoided. In the luminaire according to the cited British Patent Specification a separate cover is ued to close one of the apertures in the housing.

Another advantage of the luminaire in accordance with the invention is that the conversion of a luminaire to make it suitable for a different pole or the assembly of housing and assembly member to make the luminaire ready for pole-mounting, require no manipulations in the interior of the housing. These activities are very easy and rapid to carry out, while the luminaire can also be placed very easily and rapidly on a pole.

Figure 2:
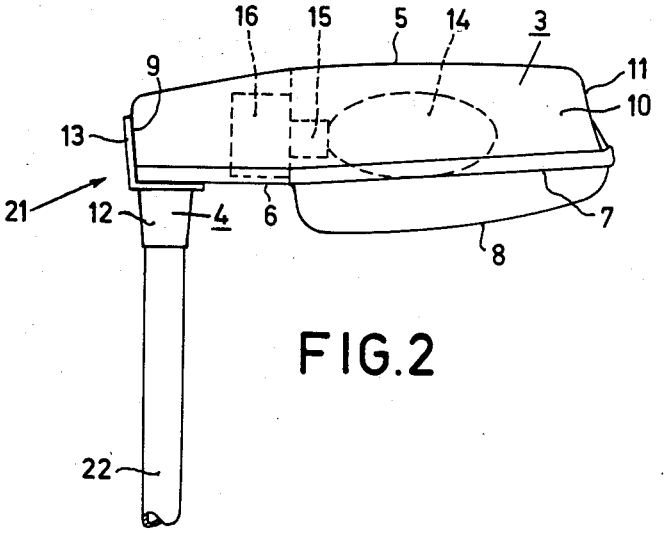
Figure 3:
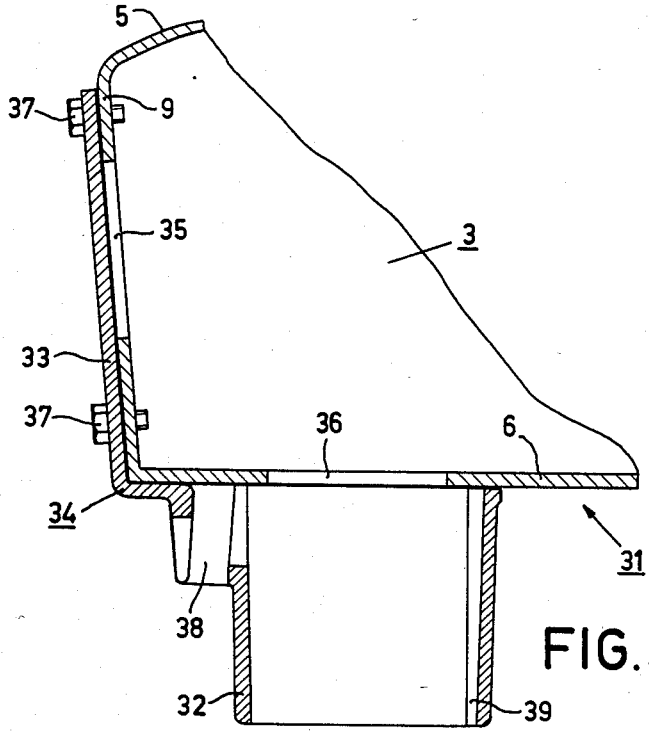
Figure 4:
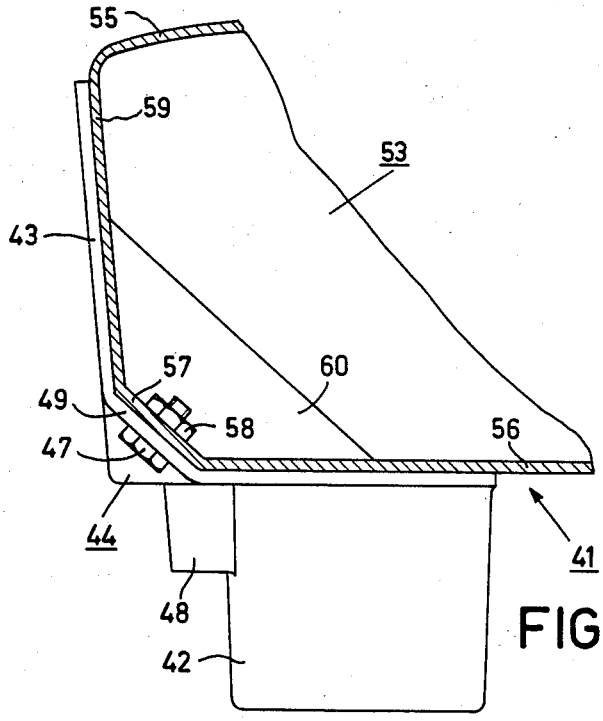

Embodiments of luminaires according to the invention are shown in the accompanying drawings. In the drawings:

FIG. 1 is a side elevation of a luminaire placed on a pole having an approximately horizontal pole end, FIG. 2 is a side elevation of a luminaire placed on a pole having a vertical pole end, FIG. 3 is a longitudinal sectional view of a part of a luminaire and FIG. 4 shows a part of a luminaire with the housing in a longitudinal sectional view and the assembly member in a side elevation.

In FIG. 1 a road illumination luminaire 1 according to the invention is mounted on a pole 2 having an approximately horizontal end. The luminaire has a housing 3 and an assembly member 4. The housing has an upper wall 5, a lower wall 6 in which a light emanating window 7 is present which is closed with a transparent hood 8, a side wall 9 and other side walls 10 and 11. The assembly member 4 has a sleeve 12 in which the end of the pole 2 is incorporated. The assembly member 4 furthermore has a cover member 13 from which extends the sleeve 12. The assembly member 4 is provided on the outside against the housing 3 by means of the cover member 13 over apertures in the lower wall 6 and the side wall 9, which apertures are not visible in the Figure. At the area of the cover member, the outer surfaces of the lower wall 6 and the side wall 9 are at an external angle of 255° to 270°, for example 265°, to each other. The sleeve 12 is substantially perpendicular to the surface of the side wall 9.

An electric gas discharge lamp 14 incorporated in a lamp holder 15 and supplied power via a ballast 16 is present in the housing 3.

FIG. 2 shows a road illumination luminaire 21 on a pole 22 having a vertical end. The luminaire 21 has the same assembly member 4 as in FIG. 4, which, however, is secured to the housing 3 in a different position. The remaining reference numerals refer to the same components as components having the same reference numerals in FIG. 1. The sleeve 12 is essentially perpendicular to the surface of the lower wall 6.

In FIG. 3 the housing 3 of a luminaire 31 has a lower wall 6 having an aperture 36, a first side wall 9 having therein a similar aperture 35, and an upper wall 5. The luminaire 31 also has an assembly member 34 which comprises a sleeve 32 for receiving the end of a pole and a cover member 33. The assembly member 34 is secured to the housing 10 by means of bolts 37. The cover member 33 extends over the apertures 35 and 36 so that these apertures in the housing 3 are closed. The sleeve 32 is opposite to the aperture 36. The assembly member 34 has a cavity 38 in which a fixing member can be incorporated, for example a nut and bolt, with which the end of a pole can be pressed against a ridge 39 in the sleeve 32 and can thus be fixed in the sleeve 32.

In FIG. 4 the housing 53 of a luminaire 41 has a lower wall 56, a side wall 59 and an upper wall 55. The transition of the lower wall to the side wall is locally formed by an inclined face 57.

The luminaire 41 has an assembly member 44 with a sleeve 42 for receiving the end of a pole, and a cover member 43. The assembly member 44 has a cavity 48 for receiving fixing means to fix a pole in the sleeve 42. The cover member 43 has an inclined face 49 which corresponds to the inclined face 57 of the housing 53 through which the assembly member 44 is drawn against the housing 53 by means of a bolt 47 and a nut 58. Reference numeral 60 denotes a reinforcement rib of the assembly member 44.

The sleeve 42 is opposite to an aperture in the lower wall 56, not visible in the Figure. The cover member 43 is connected over said aperture in the lower wall and over an aperture in the side wall 59 which is also not visible in the Figure. At the area of the cover member 42 the outer surfaces of the lower wall 56 and the first upright side wall 59 are at an angle of approximately 265° to each other. The sleeve 42 is substantially perpendicular to said surface of the lower wall 56.

I claim:

1. A road illumination luminaire for mounting on an associated pole which comprises: a housing having a lower wall in which a light-emanating window is present, an upper wall, and side walls; said housing having an aperture in said lower wall and an aperture in one of said side walls, each aperture being dimensioned and configured for cooperation with the end of the associated pole with one of said apertures facing a pole end; means to fix said luminaire to the associated pole, said means comprising a unitary cover member and a sleeve extending from said cover member for receiving therein the end of the associated pole, said sleeve and said cover member having substantially aligned bores extending through them, said cover member being secured against the outside of said housing of said luminaire, said cover member extending over both said aperture in said lower wall and said aperture in said side wall, said cover member being securable to said housing with said aligned bores substantially aligned with one of said apertures, the outer surface of said lower wall and the outer surface of said one side wall at respective areas where said cover member is securable against said housing are at an external angle of 255° to 270° to each other and said sleeve extends substantially perpendicularly to one of said outer surfaces, the connection of said lower wall to said one side wall of said housing in the region of said cover member is defined by an inclined face which is inclined with respect to each of said outer surfaces, said cover member having a corresponding inclined face through which said means is secured to said housing by means of a bolt.

* * * * *